US009123269B2

(12) United States Patent
Fields

(10) Patent No.: US 9,123,269 B2
(45) Date of Patent: Sep. 1, 2015

(54) SYSTEM FOR DISPLAYING MESSAGE ON A CORD

(75) Inventor: Eric Fields, Northbrook, IL (US)

(73) Assignee: Eric Fields, Northbrook, IL (US)

( * ) Notice: Subject to any disclaimer, the term of this patent is extended or adjusted under 35 U.S.C. 154(b) by 95 days.

(21) Appl. No.: 13/996,052

(22) PCT Filed: Sep. 27, 2011

(86) PCT No.: PCT/US2011/053397

§ 371 (c)(1),
(2), (4) Date: Jun. 20, 2013

(87) PCT Pub. No.: WO2012/087396

PCT Pub. Date: Jun. 28, 2012

(65) Prior Publication Data

US 2013/0263483 A1 Oct. 10, 2013

Related U.S. Application Data

(63) Continuation-in-part of application No. 12/973,094, filed on Dec. 20, 2010, now abandoned.

(51) Int. Cl.

| | |
|---|---|
| ***G09F 3/00*** | (2006.01) |
| ***G09F 23/00*** | (2006.01) |
| ***G09F 21/02*** | (2006.01) |
| *G09F 3/06* | (2006.01) |

(52) U.S. Cl.
CPC ..... *G09F 23/00* (2013.01); *G09F 21/026* (2013.01); *G09F 3/00* (2013.01); *G09F 3/06* (2013.01)

(58) Field of Classification Search
CPC ..... G09F 3/00; G09F 6/06
USPC ..... 40/316; 174/112, 50.54, 50.51, 93; 24/115 R, 122.6, 130, 129 D, 115 A
See application file for complete search history.

(56) References Cited

U.S. PATENT DOCUMENTS

2013/0048341 A1* 2/2013 Walder et al. ..... 174/135

OTHER PUBLICATIONS

PCT Notification of Preliminary Report on Patentability, PCT/2011/053397; Apr. 20, 2012.

* cited by examiner

*Primary Examiner* — Syed A Islam
(74) *Attorney, Agent, or Firm* — Adam K. Sacharoff; Much Shelist

(57) ABSTRACT

A system for creating and displaying an advertising message on an cord or string. In the preferred embodiment, the system includes a two piece construction made up of an internal gripping sleeve that attaches to the cord or string and a fixture that includes a bore for receiving the sleeve. The bore includes a foam internal surface that permits the fixture to forcibly slid over the internal sleeve but also has a tendency to attach itself to the sleeve when not moved by the user. The external surface of the fixture includes a displayed message.

3 Claims, 8 Drawing Sheets

SYSTEM FOR DISPLAYING MESSAGE ON A CORD

BACKGROUND OF THE INVENTION

This invention relates generally to creating and displaying an advertising message on a electronic headphone cord, clothing string, or lanyard, referred generally as a cord.

There are many known ornamental attachments designed for various objects such as vehicle antennas, head phone buds, and shoes. Traditional antenna attachments are formed by boring a hole through the center of the attachment. Such prior art attachments are secured to by threading the antenna through the hole. There are known problems with this method of attachment in that when vehicle antenna generally have a tip with a larger diameter than the rod of the antenna, so the mounting hole is undesirably enlarged when sliding the attachment onto the antenna, making it difficult or impossible for the attachment to remain securely positioned on a particular place on the antenna. The '820 patent teaches an improvement wherein the channel contains recesses to accommodate the larger antenna tip. While the '820 is a significant improvement over the prior art, it suffers from at least three shortcomings. First, it relies on the center bore channel of the prior art for attachment which allows the attachment to be undesirably rotated when the vehicle is traveling at high speeds. Second, antenna tips are not standardized so unique attachment must be prepared for each different size an style of antenna tip. Third, the '820 is limited to attachments contemplated, prepared, and distributed by the manufacturer. Similar issues would arise with attaching a similar system to an electronic headphone cord. The base plug of the electronic headphone cord is abnormally large compared to the cord itself. This would indicate that a fixture with a mounting hole or bore would have to be enlarged to accommodate the base plug but would then be two large to be able to securely fashion at any particular spot on the cord without continuing to slid.

What is needed is an improved system that permits advertisement fixture to be secured to electronic headphone cords, cord strings, or lanyard cords, generally referred to as cords, that overcomes limitations and problems to provide the consumer with a flexible, easy, and reliable system to place advertising messages for display on an electronic headphone cord or clothing string.

SUMMARY OF THE INVENTION

The present invention solves these problems by departing from the prior art method of providing a unitary attachment having a center bored hole. The present system according to one embodiment for creating and displaying an advertising message on an cord, such as a headphone cord, clothing string, or lanyard cord, which includes a two piece construction made up of an internal gripping sleeve that attaches to the cord or string and a fixture that includes a bore for receiving the sleeve. The bore includes a foam internal surface that permits the fixture to forcibly slid over the internal sleeve but also has a tendency to attach itself to the sleeve when not moved by the user. The external surface of the fixture includes a displayed message. The displayed message is defined generally to include both textual messages, symbols, color patterns, and graphic images. The type of messages contemplated include, but is not limited to, personal, commercial, seasonal, political, and religious messages.

BRIEF DESCRIPTION OF THE SEVERAL DRAWINGS

DETAILED DESCRIPTION OF THE INVENTION

The present invention generally allows a consumer to select and display an advertising message on electronic headphone cords, on clothing sting cords, and on lanyard cords, generally referred to herein as a cord. An advertising message is defined generally to include both textual messages, symbols, color patterns, and graphic images. The type of messages contemplated include, but is not limited to, personal, commercial, seasonal, political, and religious messages.

Figure 1:
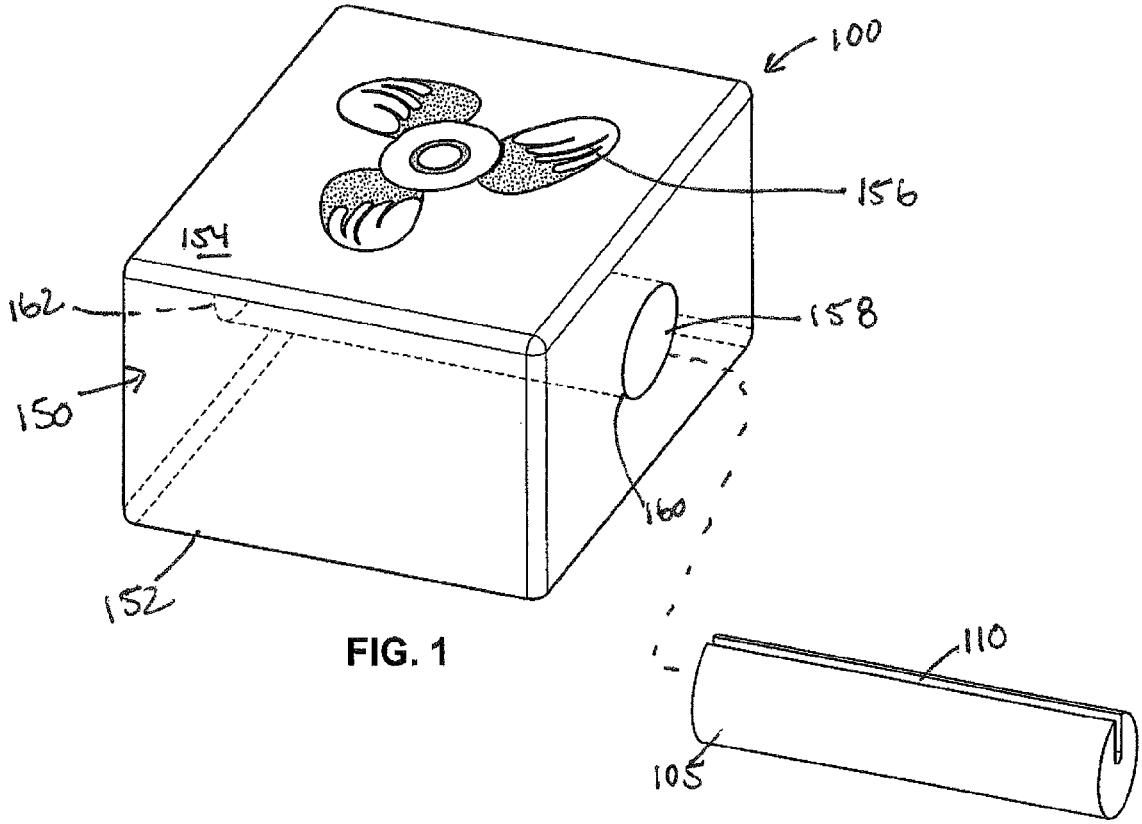
FIG. 1 illustrates one embodiment of the present invention showing a two piece construction of the system for displaying a message on a cord or string.
Figure 2:
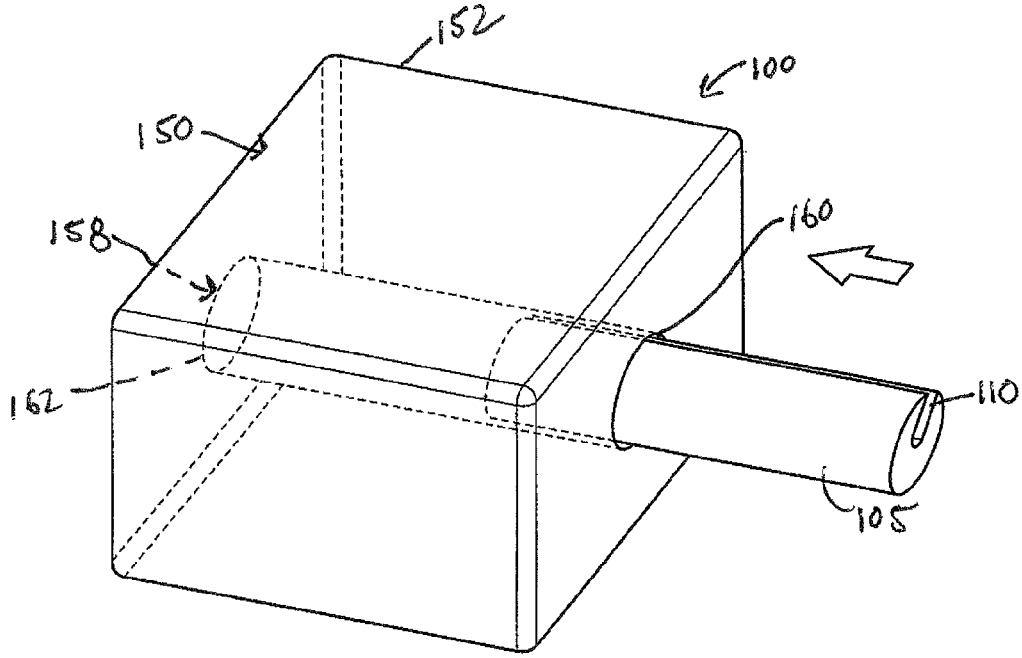
FIG. 2 illustrates the fixture sliding onto the sleeve.
Figure 3A:
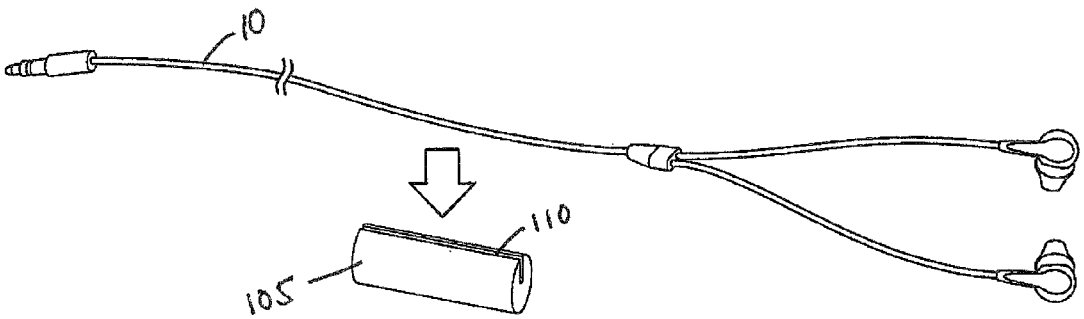
FIG. 3A illustrates the sleeve being secured to the cord.
Figure 3B:
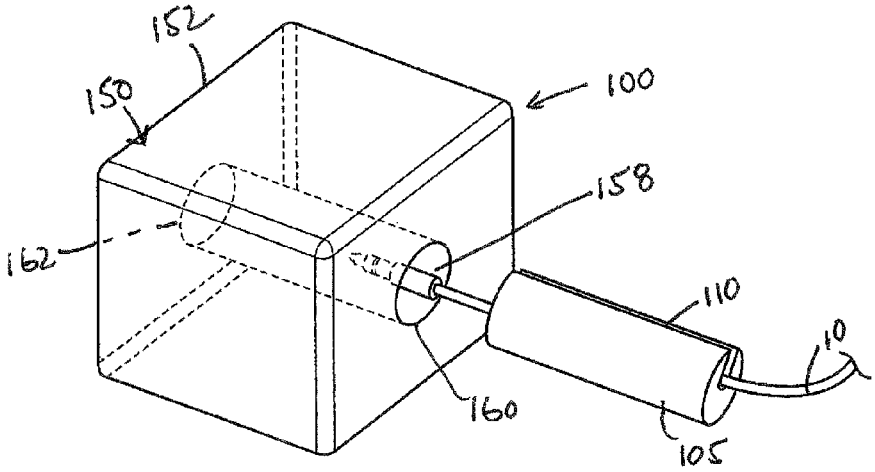
FIG. 3B illustrates the fixture sliding over the cord end.
Figure 3C:
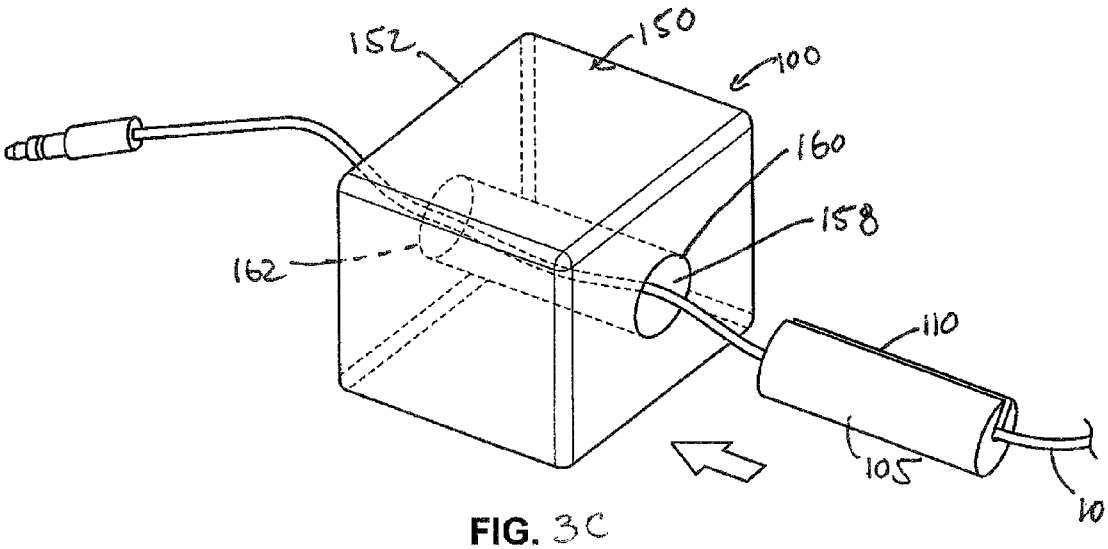
FIG. 3C illustrates the fixture and sleeve on the cord.
Figure 3D:
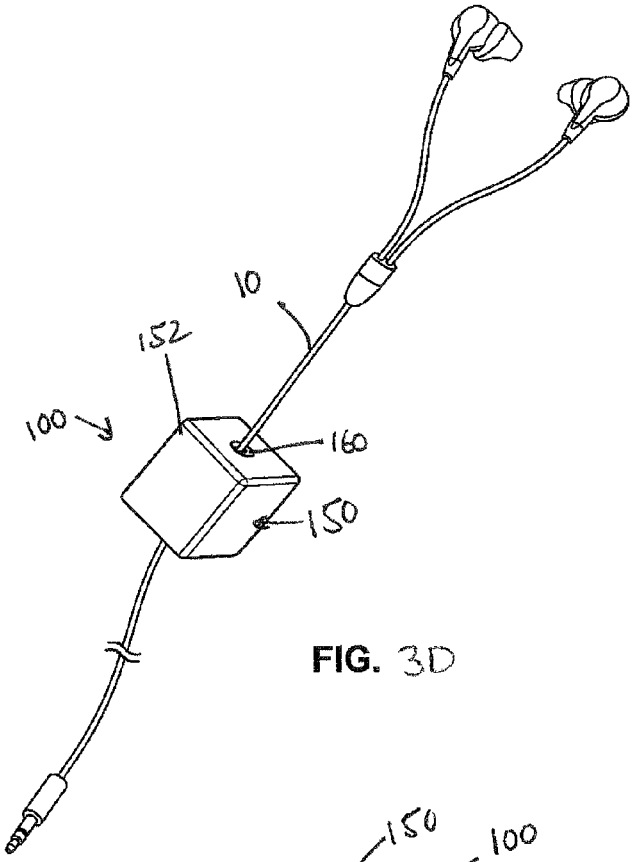
FIG. 3D illustrates the fixture and sleeve on the cord.
Figure 3E:
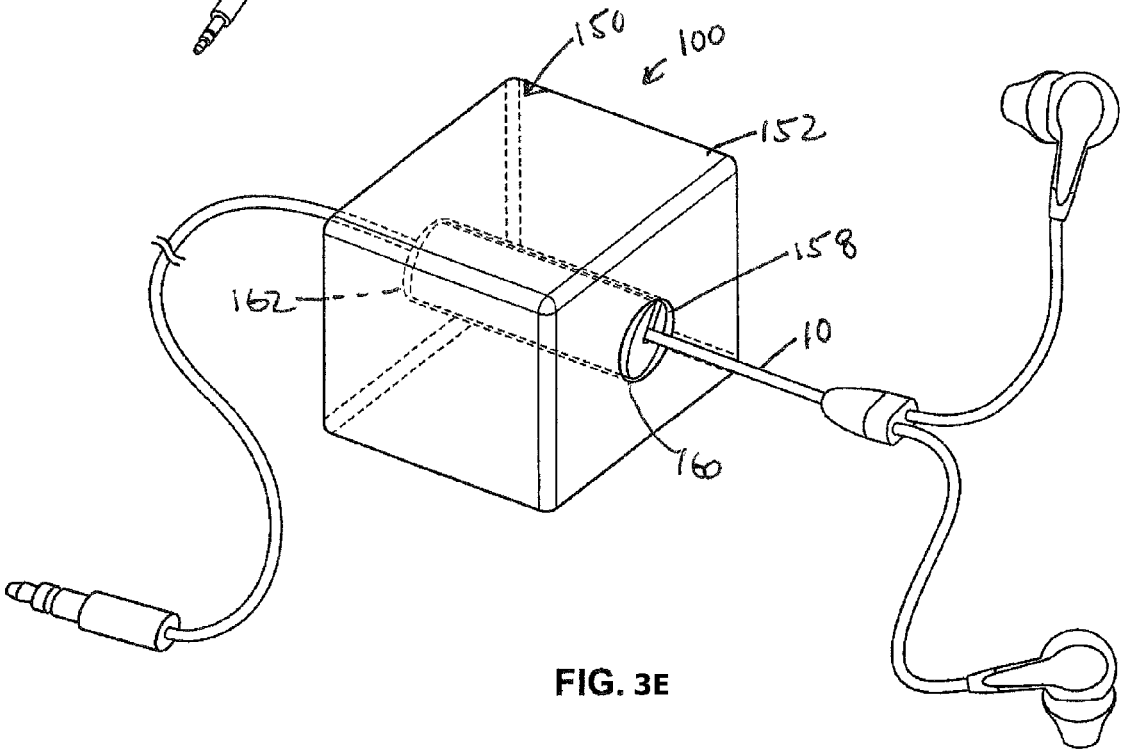
FIG. 3E illustrates the fixture and sleeve on the cord.

FIGS. 1-4B shows the preferred embodiment of the invention as typically deployed on an electronic headphone cord. Referring to FIG. 1, the cord 10 holds the system invention 100 at a position defined by the user. This position can be adjusted by sliding the system invention 100 along the cord.

The system invention 100 is typically defined as a two piece construction, which a single piece construction may be defined two pieces tends to provide the best flexibility. The two piece construction includes an internal sleeve 105 and an external fixture 150. The internal sleeve 105 made be a latex rubber or silicon sleeve. The sleeve 105 includes a groove or slit 110 along its length that permits the sleeve 105 to open for receiving the cord 10. Once released the slit will close and grip onto the cord 10. While the sleeve 105 can still be manually slid upwardly or downwardly along the cord, the material being sufficiently resilient will substantially prevent the sleeve 105 from moving on its own.

The external fixture 150 while shown as a cube, may be any particular geometric shape and/or size. The fixture 150 can include at least one face which is preprinted on to include a particular advertisement, such as those discussed. The advertisement may be on one or more faces of the fixture, if the fixture includes a face. The fixture is typically made out of an expanded rubber foam such as ethylene vinyl acetate form rubber. The foam structure 152 is cut, sized, or shaped to have a profile that may include at least one face. The face will typically be coated or painted 154 that permits the printing of the advertisement 156. The fixture 150 further includes a bore 158 there-through such that the bore extends along a single axis to create an opening on one end 160 and an exit on the opposing end 162.

With the sleeve secured to the cord as previously described, the fixture 150 may now be positioned. The bore 158 is sized such that the internal surface 160 of the bore frictionally engages the external surface 110 of the sleeve 105. The bore 158 is also sized such that a plug or knot at the beginning of the cord can slide there-through. Since the fixture 150 is also made from an expanded rubber, if the bore 158 is slightly smaller then the plug, the plug can still be slide through the bore by forcibly expanded the bore when the plug is pushed through. The fixture can then be slide along the cord and positioned such that the sleeve is placed internally within the fixture.

It may be further contemplated that the sleeve is longer then the fixture, such that ends of the sleeve extend out of the fixture. This can be done for various reasons including further advertisement or marketing purposes.

The advertising messages formed using the present invention may be textual messages. The messages may also be artistic rather than textual where the symbolic attachments represent non-textual items such as hearts and flowers. The messages may be seasonal such as "Veterans Day" or religious, such as "God Loves".

Figure 4A:
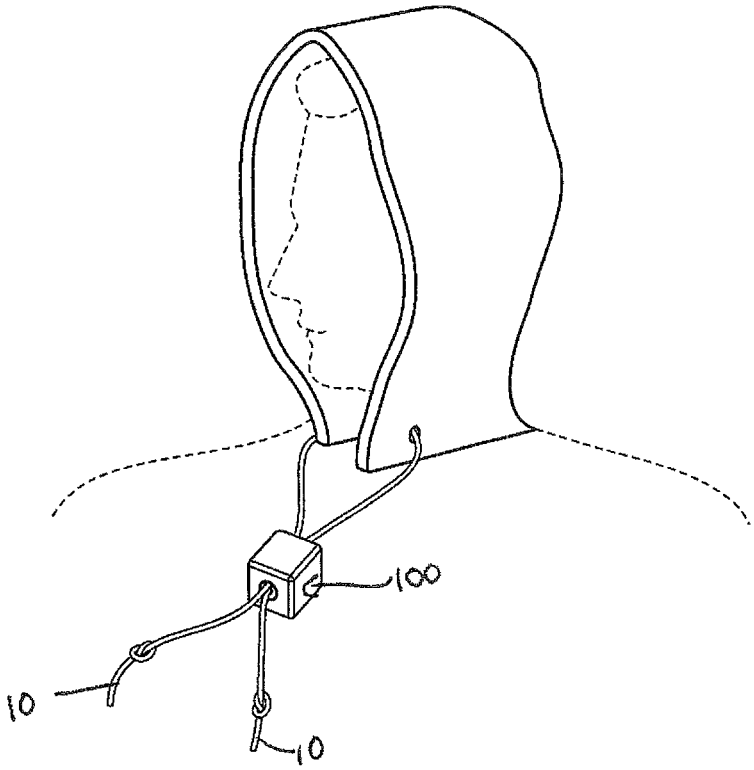
FIG. 4A illustrates the fixture and sleeve on a clothing cord.
Figure 4B:
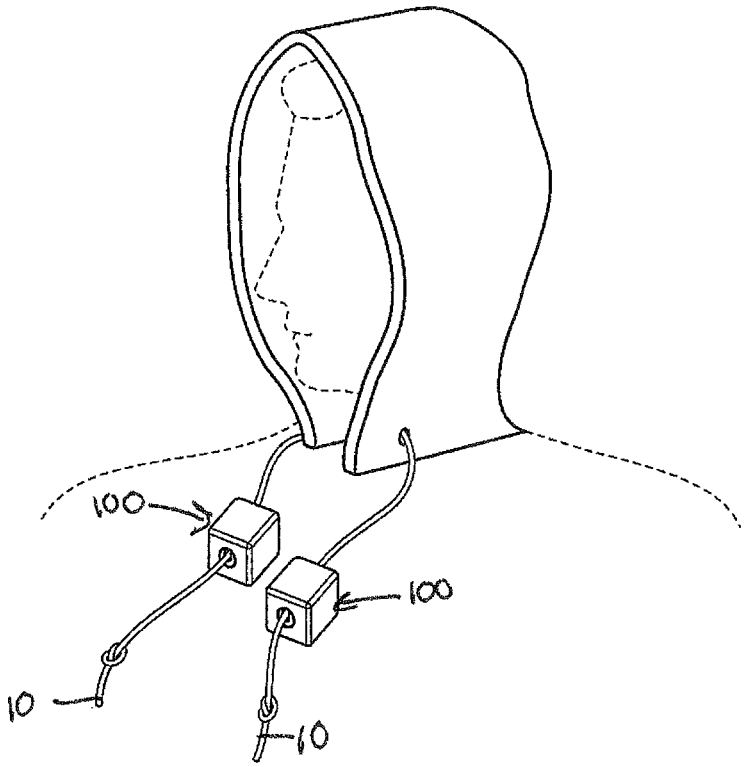
FIG. 4B illustrates the fixture and sleeve on each separate cord on the clothing.

As illustrated in FIGS. 4A and 4B the system 100 can either singularly placed on two cords 10 on a piece of clothing or have two placed separately each one on one cord. Furthermore, the fixture could also be placed on a lanyard or other type of chain or cord.

Figure 5A:
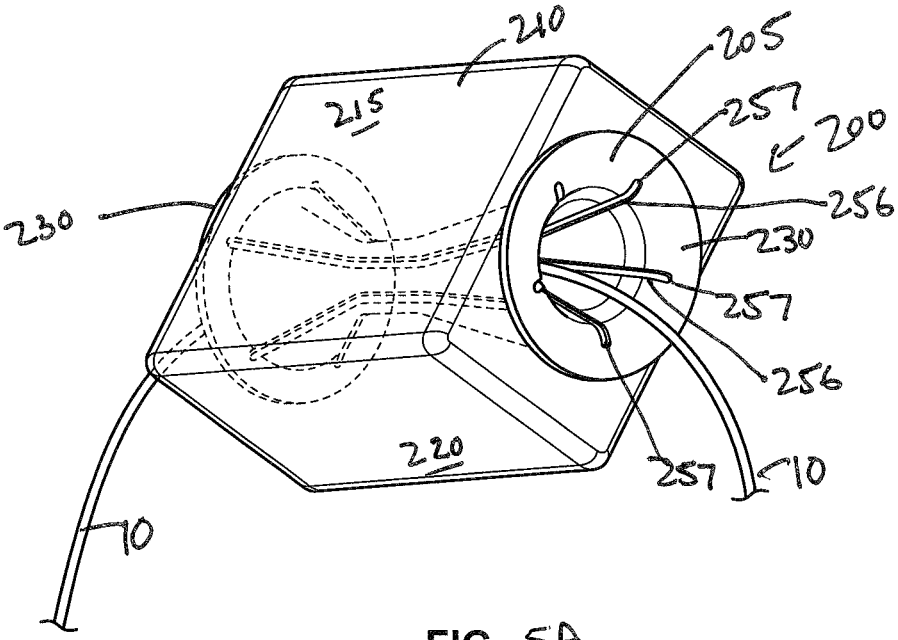
FIG. 5A illustrates another embodiment of the present invention.
Figure 5C:
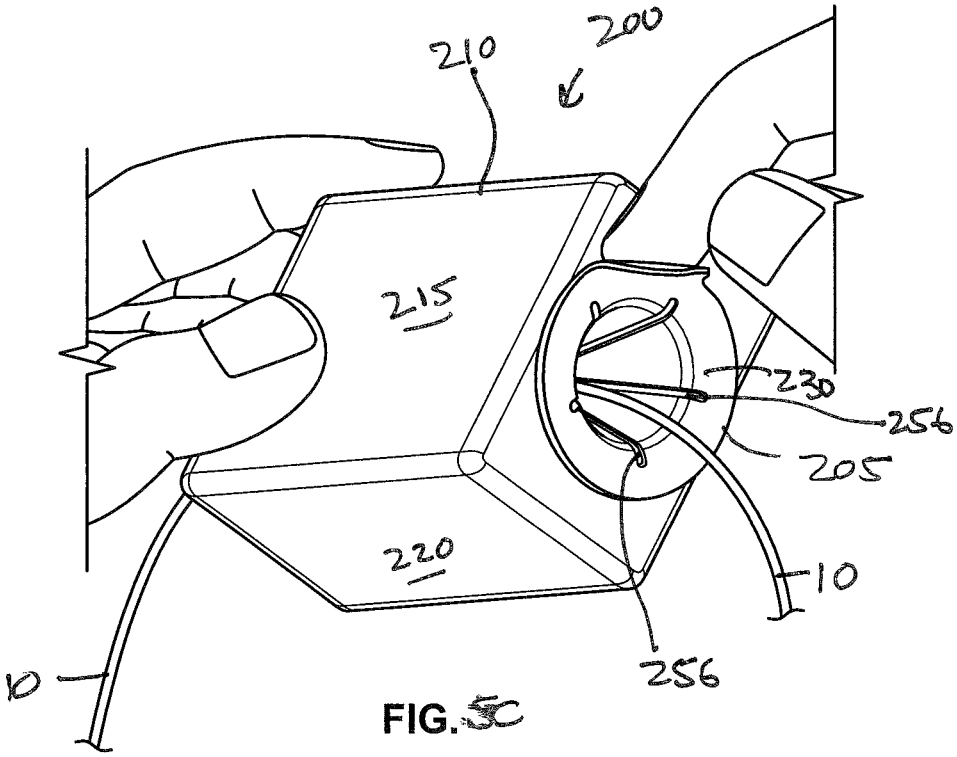
FIG. 5C illustrates a user grasping an edge of the conical member before twisting.
Figure 5B:
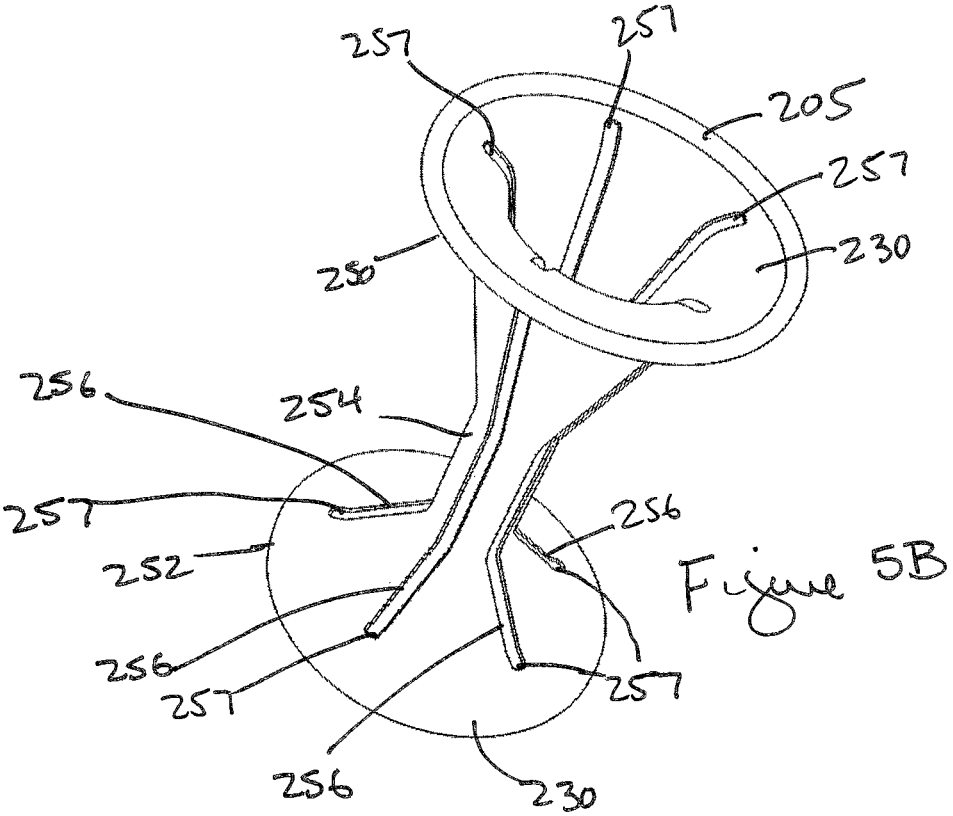
FIG. 5B illustrates the internal conical member used to capture the cord.
Figure 6A:
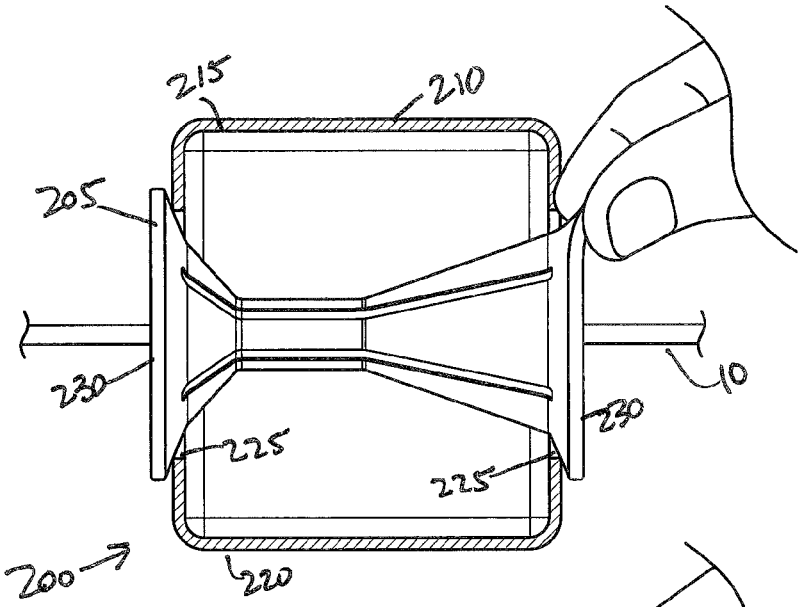
FIG. 6A-6C illustrates the twisting which occurs internally to the internal bi-conical member when capturing the cord.
Figure 6B:
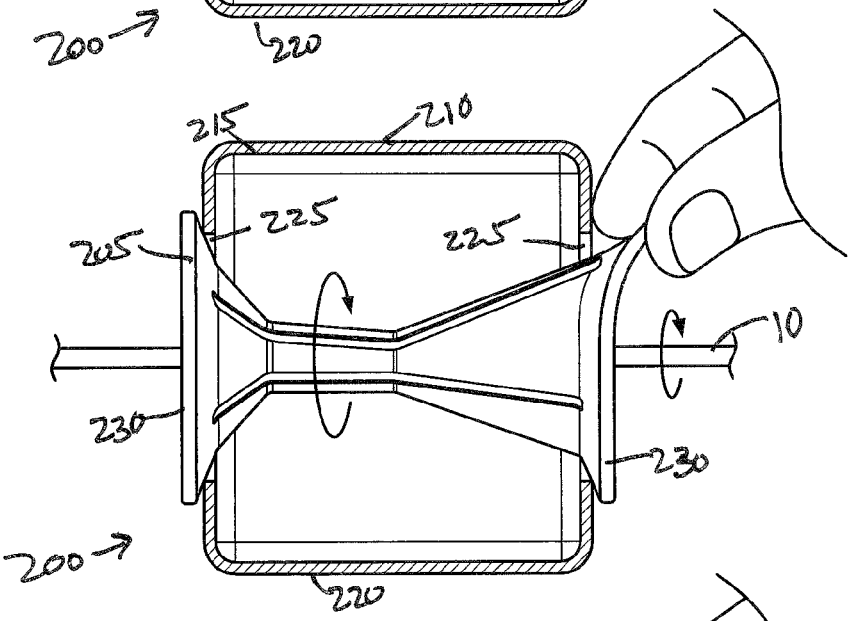
Figure 6C:
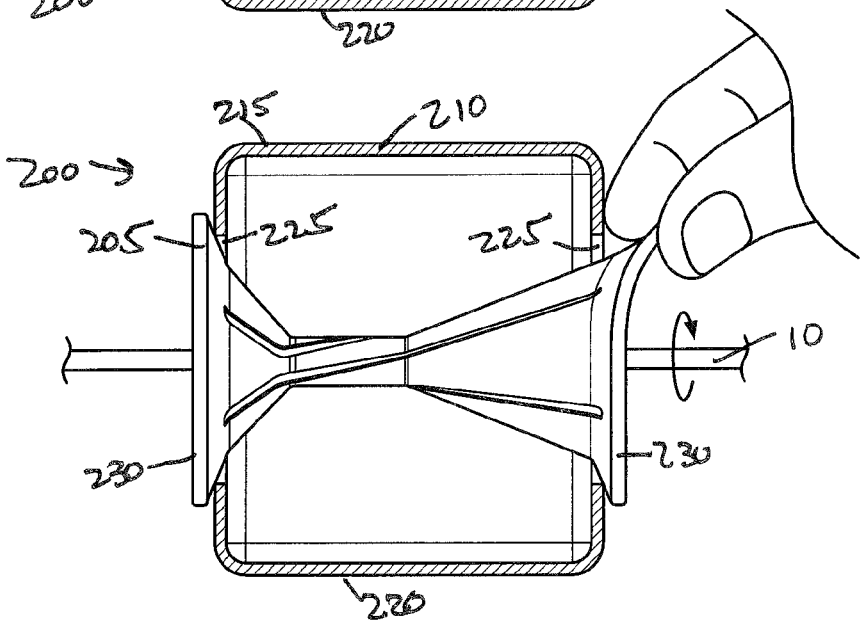
Figure 7A:
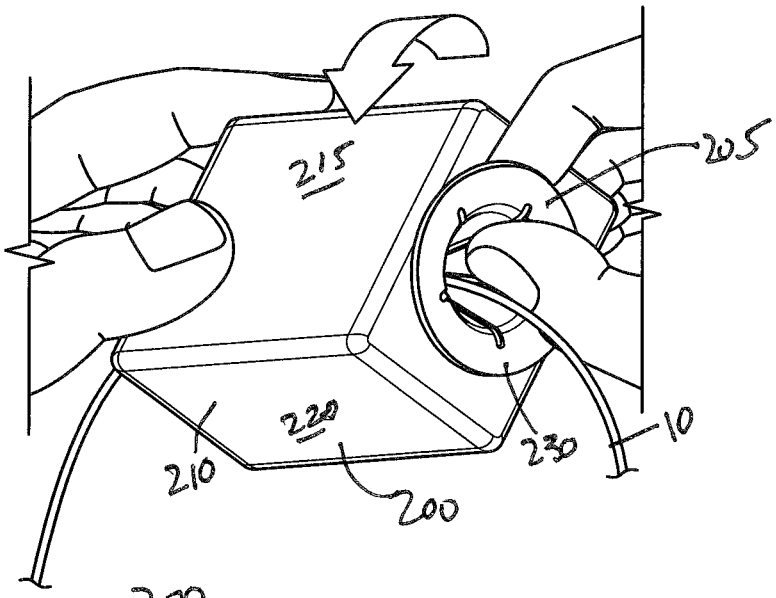
FIG. 7A-7C illustrates from an external viewpoint the twisting to the fixture.
Figure 7B:
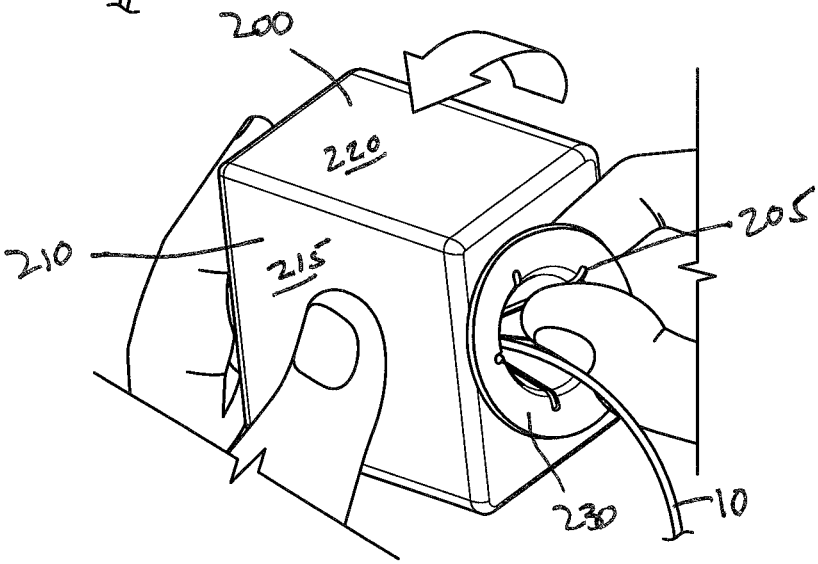
Figure 7C:
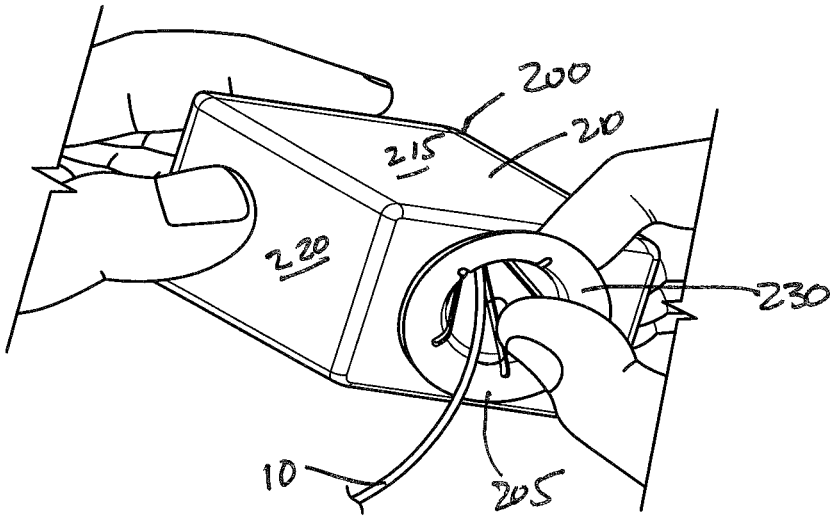

Referring now to FIGS. 5A and 5B there is shown a second type of apparatus invention 200 typically defined as a two piece construction, defined as an internal sleeve 205 and an external fixture 210. The external fixture may be constructed as a two piece housing 215 and 220 that combined to form the external fixture 210 but is secured two each other during assembly by epoxy, glue, adhesive and may even be secured through mechanical devices, screws, etc.

The external fixture 210 is typically hollow and includes openings 225 on opposing ends. The openings 225 are sized to receive the outwardly flared ends 230 of the internal sleeve 205, such that the flared ends 230 of the internal sleeve 205 are positioned externally to the openings 225. The openings 225 may either be of the size dimensions or may be slightly different to accommodate variations of the internal sleeve.

The internal sleeve 205 is bi-conically shaped with the two outwardly flared ends 230 defined on end portions 250 and 252. The two end portions 250 and 252 inwardly taper towards a narrowed intermediate section 254. The degree of tapering for either end portion 250 or 252 may be the same or different. In addition, the internal sleeve 205 includes slots 256 traversing the length of the sleeve. The slot ends 257 terminate along the length of the sleeve such that the slot end 257 is closed and not opened. The number of slots 256 on any given embodiment may differ, however, in one embodiment the slots 256 traverse the length of the sleeve and are evenly spaced.

Referring now to FIGS. 6A-7C, the elements of the internal sleeve allow a user to grip one of the flared ends and twist either the internal sleeve or the fixture causing the internal sleeve to twist about its narrowed intermediate section and grip or secure a cord in place. The slots 256 further allow the internal sleeve to flex and twist about the narrowed intermediate section while maintaining the opposing flared end to stay in position without any securing means or mechanisms. Therefore, the use can easily twist and untwist one of the flared ends and then flip and twist/untwist the other end easily and effectively. To use the invention, the user would insert the cord through the internal sleeve—simple pushing the cord through will suffice. Once through and positioned, the user simply grips one of the flared ends and twists, causing the internal sleeve to grab and hold the cord. The internal sleeve will maintain its grasp until a user untwists the internal sleeve.

The description of the invention above includes several embodiments of the invention, but as one skilled in the art will appreciate, there are other uses and applications not explicitly illustrated in the description above that nevertheless are consistent with the spirit of the disclosed invention. The description above is provided by way of illustration and not limitation, and the invention, accordingly, should only be limited by the claims as set forth below.

What is claimed is:

1. An apparatus for displaying an advertising message on an cord, comprising:

an internal sleeve capable of capturing and gripping the cord, the internal sleeve is substantially a bi-conically shaped structure having end portions that taper towards and connect to a narrowed intermediate section, the internal sleeve further includes at least one closed ended slot traversing the length of the sleeve; and an external fixture is having a pair of opposing openings, each sized to receive an end portion of the internal sleeve, and wherein the internal sleeve is further hollow to receive a cord and is made of a flexible material capable of permitting the internal sleeve to twist at one of the end portions about the narrowed intermediate section while the opposing end portion remains substantially un-moved.

2. The apparatus of claim 1, wherein the two end portions of the internal sleeve are further outwardly flared externally to the external fixture.

3. The apparatus of claim 1, wherein the fixture includes a face having an advertising message printed thereon.

* * * * *